US011238838B2

(12) United States Patent
Iwahashi et al.

(10) Patent No.: US 11,238,838 B2
(45) Date of Patent: Feb. 1, 2022

(54) BRASS INSTRUMENT

(71) Applicant: ANGEL HORN CORP., Tokyo (JP)

(72) Inventors: Takamitsu Iwahashi, Yokohama (JP); Hitoshi Numata, Yokohama (JP)

(73) Assignee: ANGEL HORN CORP., Tokyo (JP)

( * ) Notice: Subject to any disclaimer, the term of this patent is extended or adjusted under 35 U.S.C. 154(b) by 0 days.

(21) Appl. No.: 17/057,552

(22) PCT Filed: Apr. 28, 2020

(86) PCT No.: PCT/JP2020/018120

§ 371 (c)(1),
(2) Date: Nov. 20, 2020

(87) PCT Pub. No.: WO2021/090523

PCT Pub. Date: May 14, 2021

(65) Prior Publication Data

US 2021/0383777 A1 Dec. 9, 2021

(30) Foreign Application Priority Data

Nov. 7, 2019 (JP) ..... JP2019-202579

(51) Int. Cl.
*G10D 9/11* (2020.01)
*G10D 9/08* (2020.01)
(Continued)

(52) U.S. Cl.
CPC ..... *G10D 9/11* (2020.02); *G10D 7/10* (2013.01); *G10D 9/03* (2020.02); *G10D 9/08* (2020.02)

(58) Field of Classification Search
CPC ... G10D 9/11; G10D 9/03; G10D 9/08; G10D 7/10
See application file for complete search history.

(56) References Cited

U.S. PATENT DOCUMENTS 2,320,203 A * 5/1943 Thompson ..... G10D 7/10 84/388
2,373,110 A * 4/1945 Forssberg ..... G10D 7/10 84/387 R
(Continued)

FOREIGN PATENT DOCUMENTS

DE 20 2009 006 541 U1 7/2009
JP S55-101991 A 8/1980

OTHER PUBLICATIONS

Dec. 17, 2019 Office Action issued in Japanese Patent Application No. 2019-202579.
(Continued)

*Primary Examiner* — Robert W Horn
(74) *Attorney, Agent, or Firm* — Oliff PLC

(57) ABSTRACT

A brass instrument includes a mouthpiece configured to convert vibrations of player's lips into sound and take the sound inside; a bell configured to magnify a volume of the sound taken by the mouthpiece and release the sound to the outside; and a main tube intervening between the mouthpiece and the bell, and is characterized in that the main tube includes a main tube body formed to spread out in a spiral manner in a state in which side surfaces of the main tube body are closely attached to each other, and a part of the closely attached side surfaces of one of the tubes constitutes a part of the side surface of the closely attached other tube.

2 Claims, 16 Drawing Sheets

(51) Int. Cl.
*G10D 9/03* (2020.01)
*G10D 7/10* (2006.01)

(56) References Cited

U.S. PATENT DOCUMENTS

| | | | | | |
|---|---|---|---|---|---|
| 3,308,707 | A * | 3/1967 | Kelischek | G10D 7/063 | 84/380 C |
| 4,885,971 | A * | 12/1989 | Ostendorf | G10D 7/10 | 84/387 R |
| 5,133,238 | A * | 7/1992 | Ostendorf | G10D 7/10 | 84/387 R |
| 6,664,454 | B1 * | 12/2003 | Johnson | G10D 7/00 | 84/377 |
| 10,593,308 | B2 * | 3/2020 | Clissold | G10D 9/04 | |
| 10,825,428 | B2 * | 11/2020 | Clissold | G10D 9/08 | |

OTHER PUBLICATIONS

Mar. 24, 2020 Office Action issued in Japanese Patent Application No. 2019-202579.

Jul. 14, 2020 International Search Report issued in International Patent Application No. PCT/JP2020/018120.

Jul. 14, 2020 Written Opinion issued in International Patent Application No. PCT/JP2020/018120.

Uetomo, [online], Aug. 23, 2015 [retrieved on Jul. 2, 2020], Retrieved from the Internet: <URL: twitter.com/hornworkman/status/635444236767244288?lang=fr>.

Playtech / Plastic French Horn Black PTHR100BK, [online], Apr. 5, 2019, [retrieved on Jul. 2, 2020], Retrieved from the Internet: <URL: web.archive.org/web/20190405124317/https://www.soundhouse.co.jp/products/detail/item/247597/>.

* cited by examiner

【FIG.1】
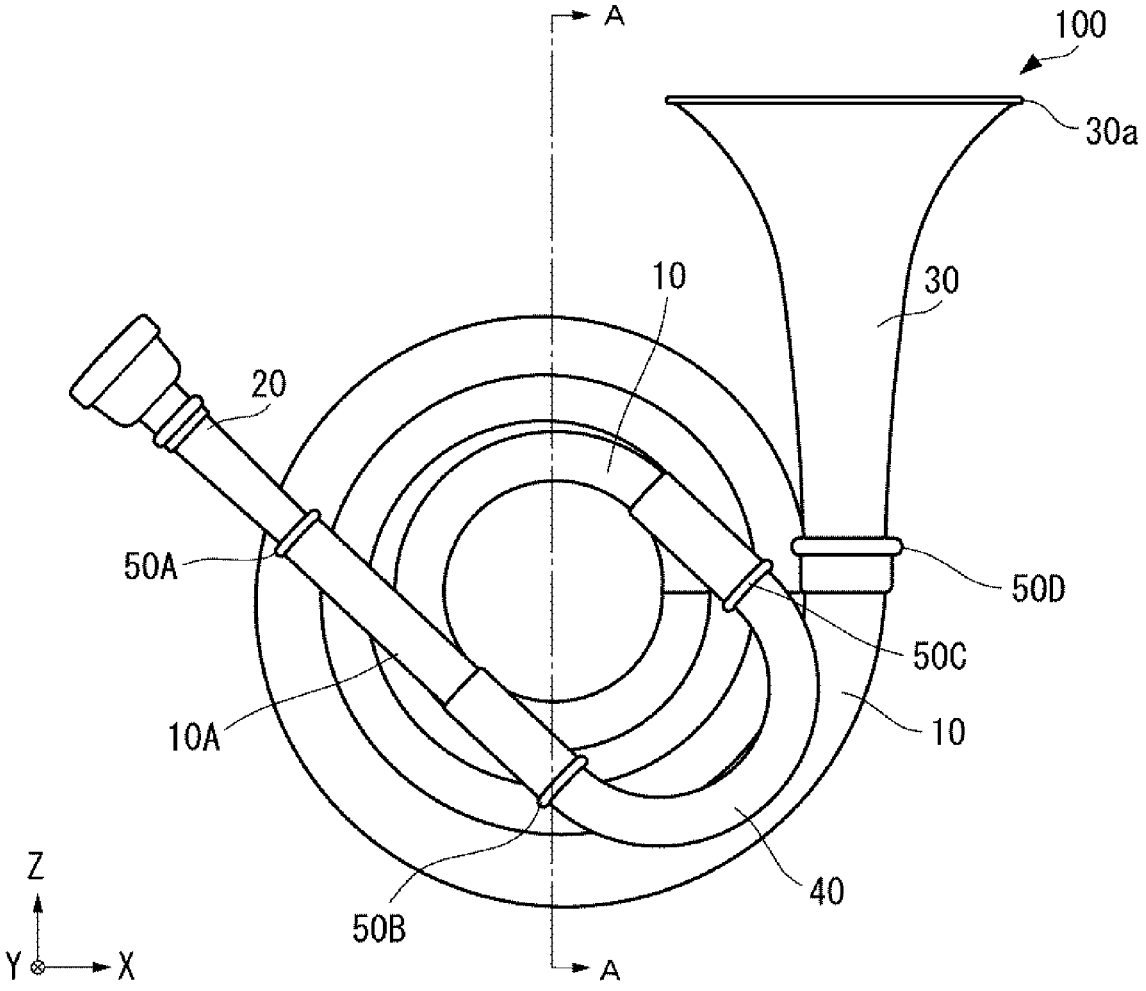

【FIG.2】
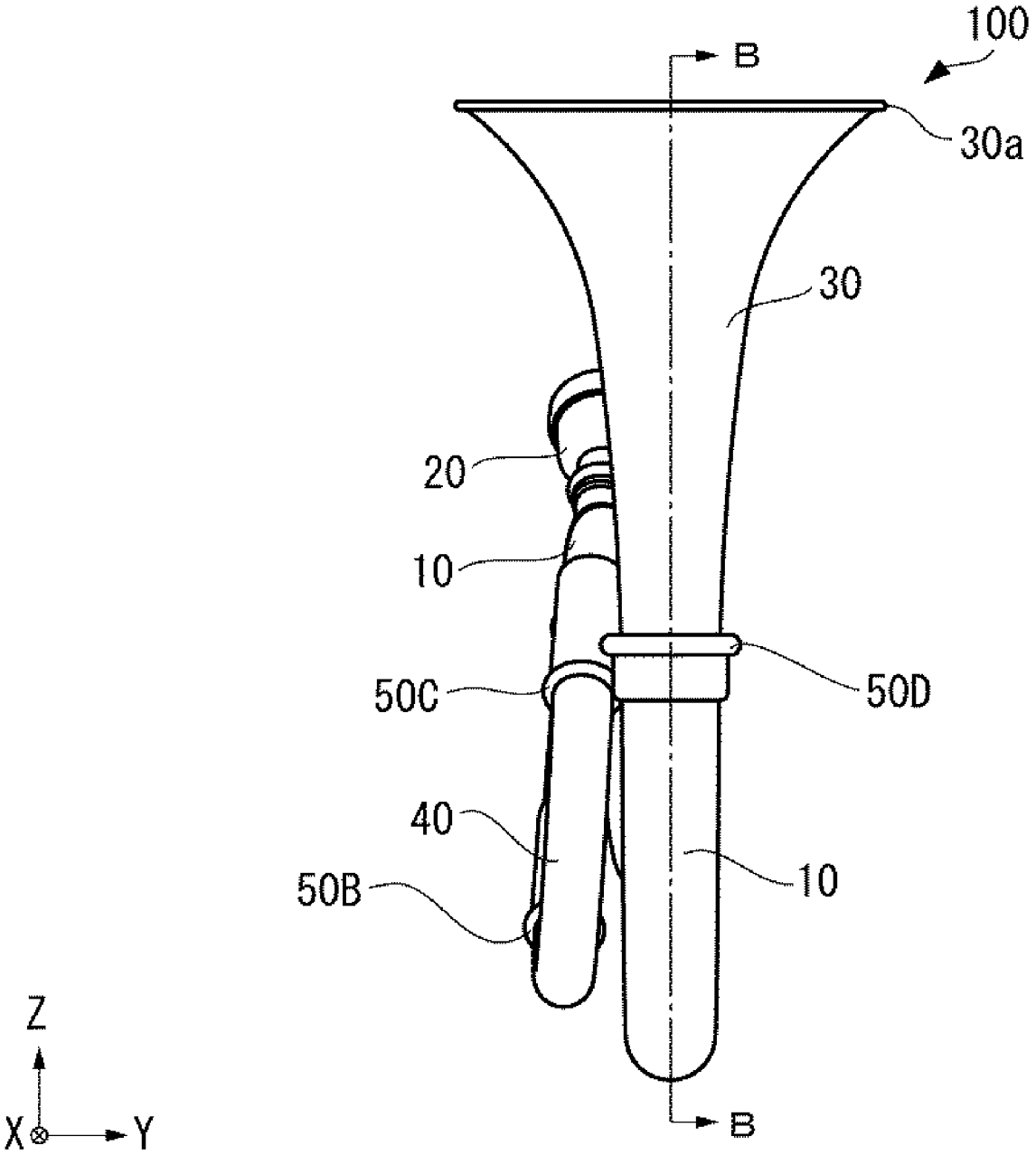

【FIG.3】
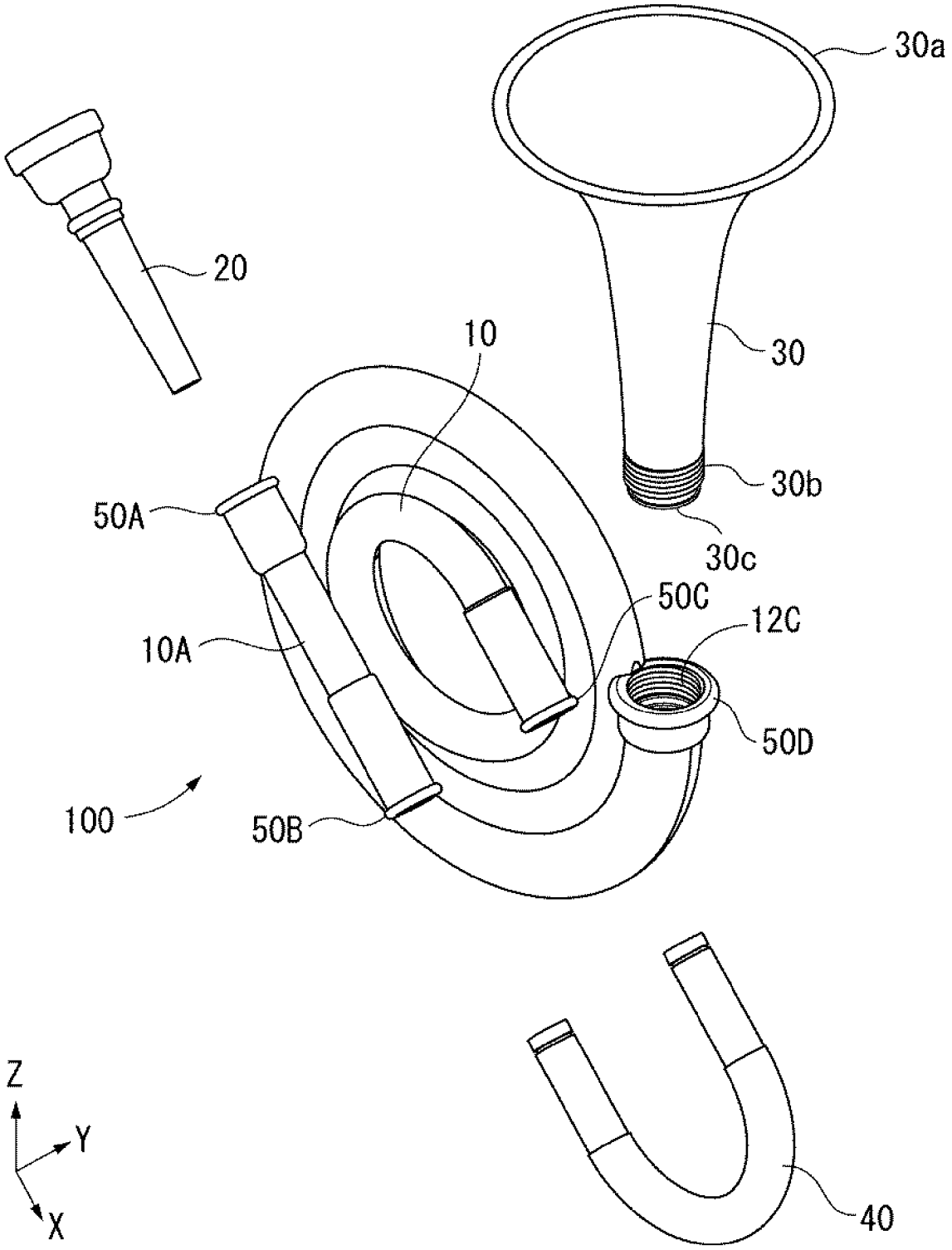

【FIG.4】
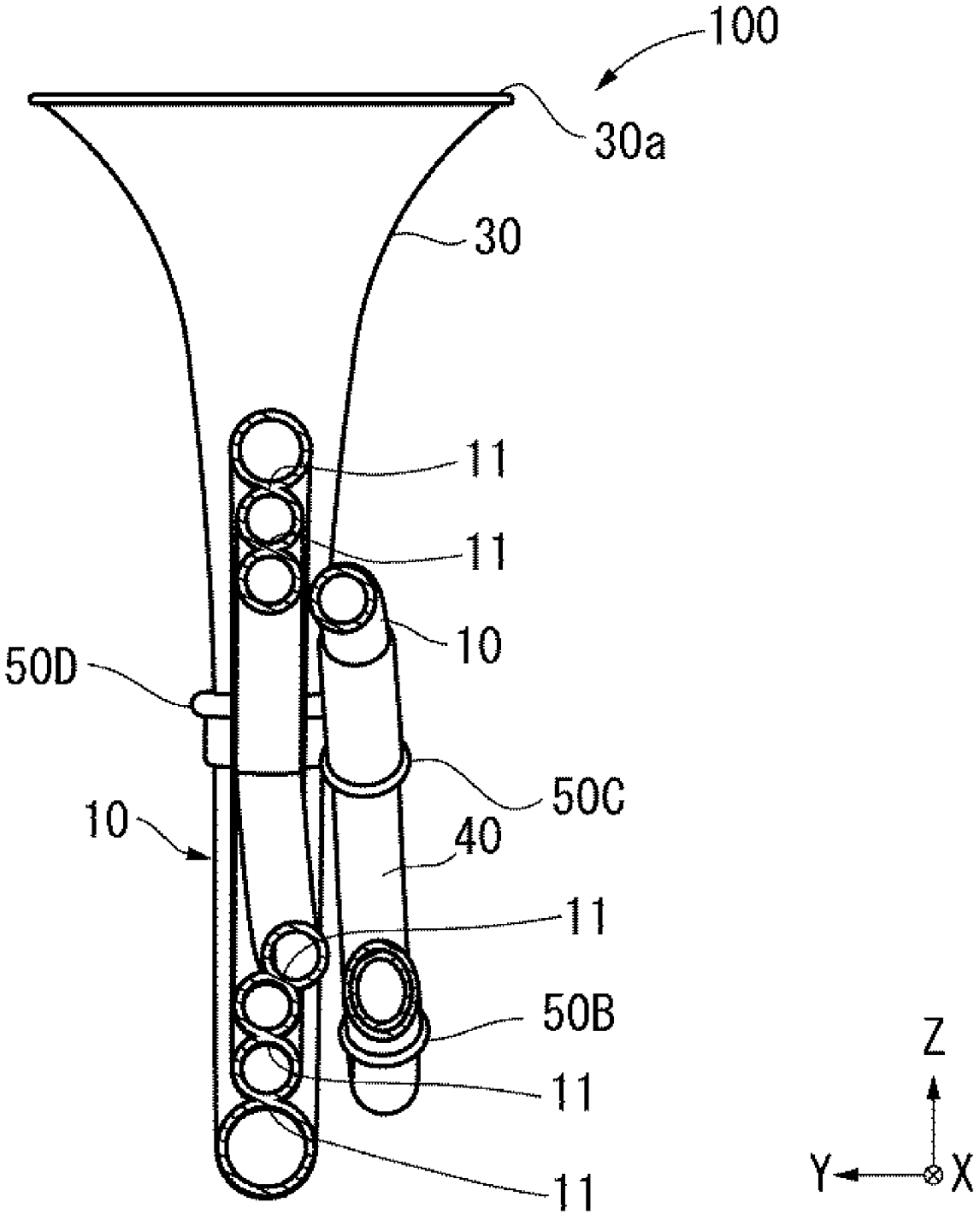

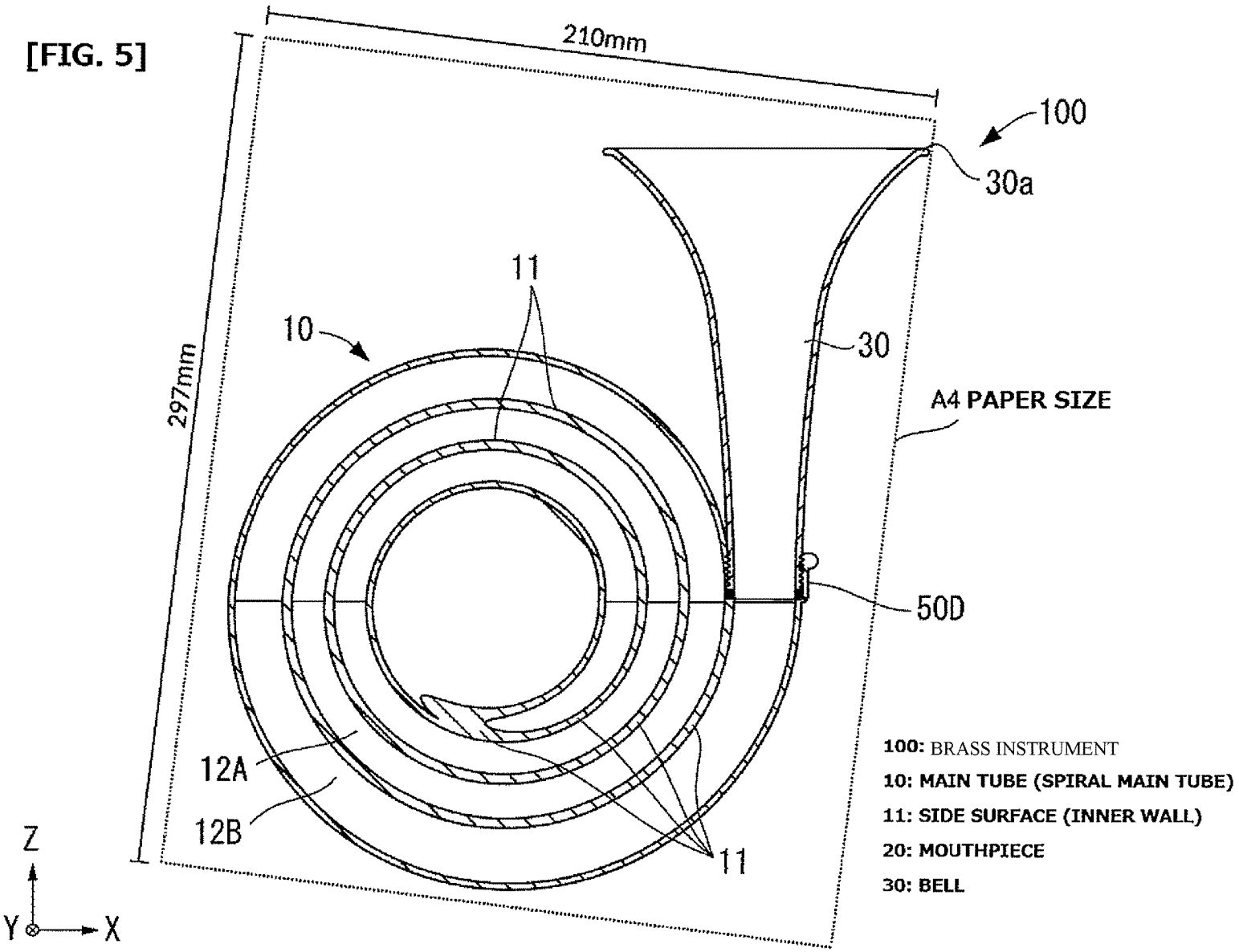
[FIG. 5]

【FIG.6】
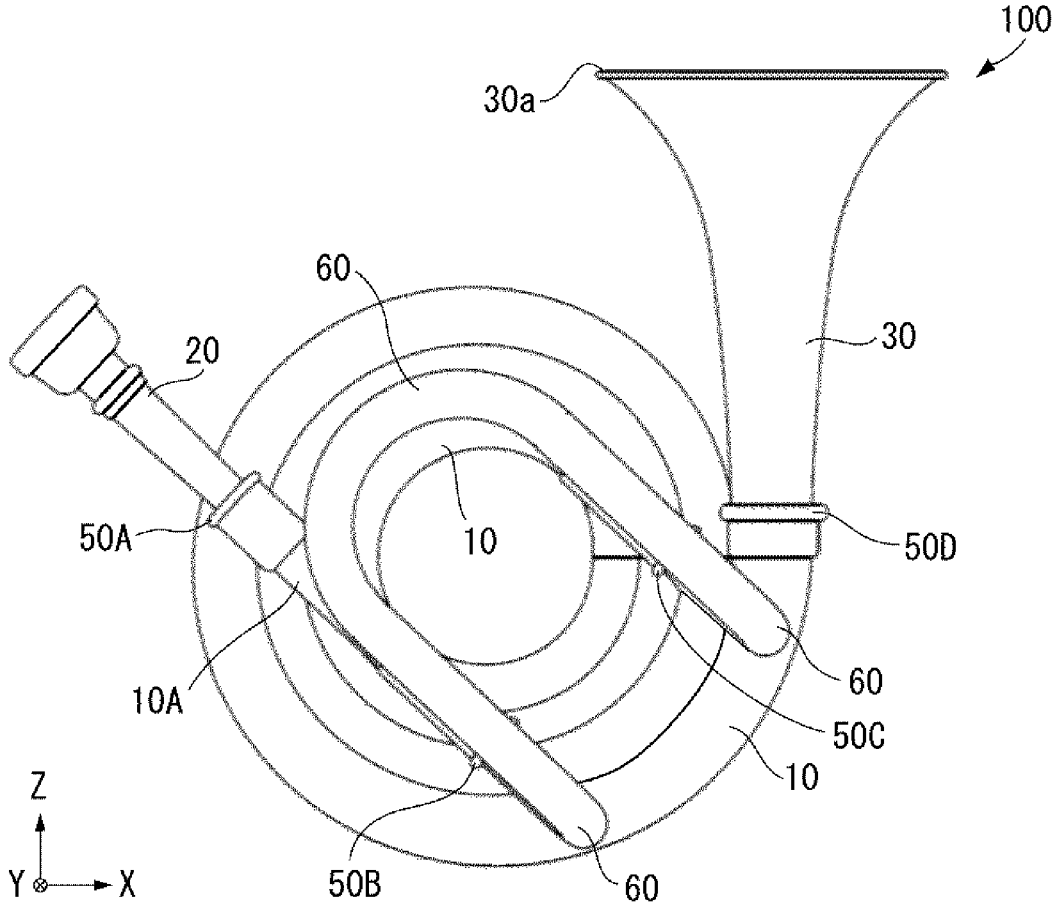

【FIG.7】
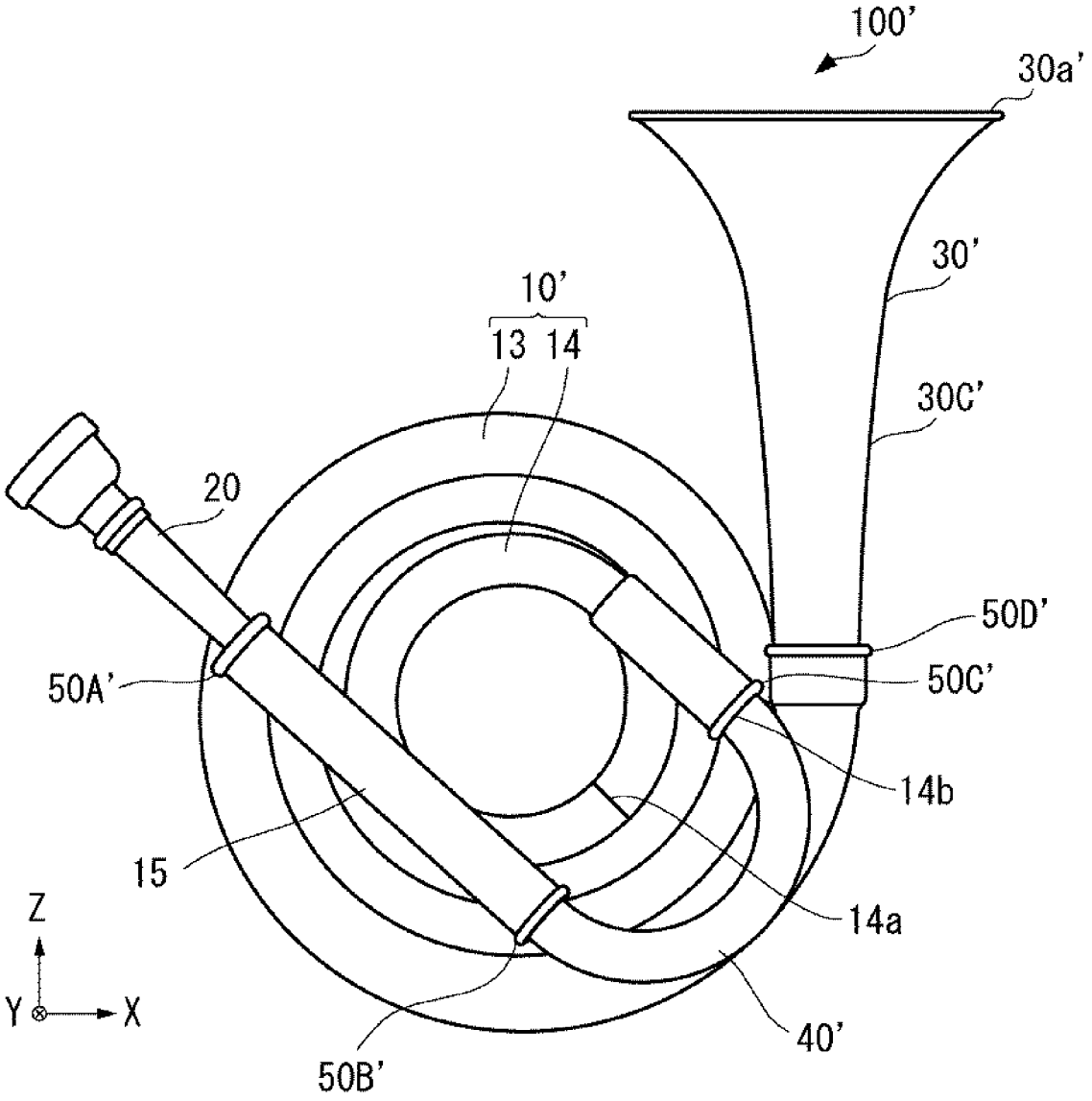

【FIG.8】
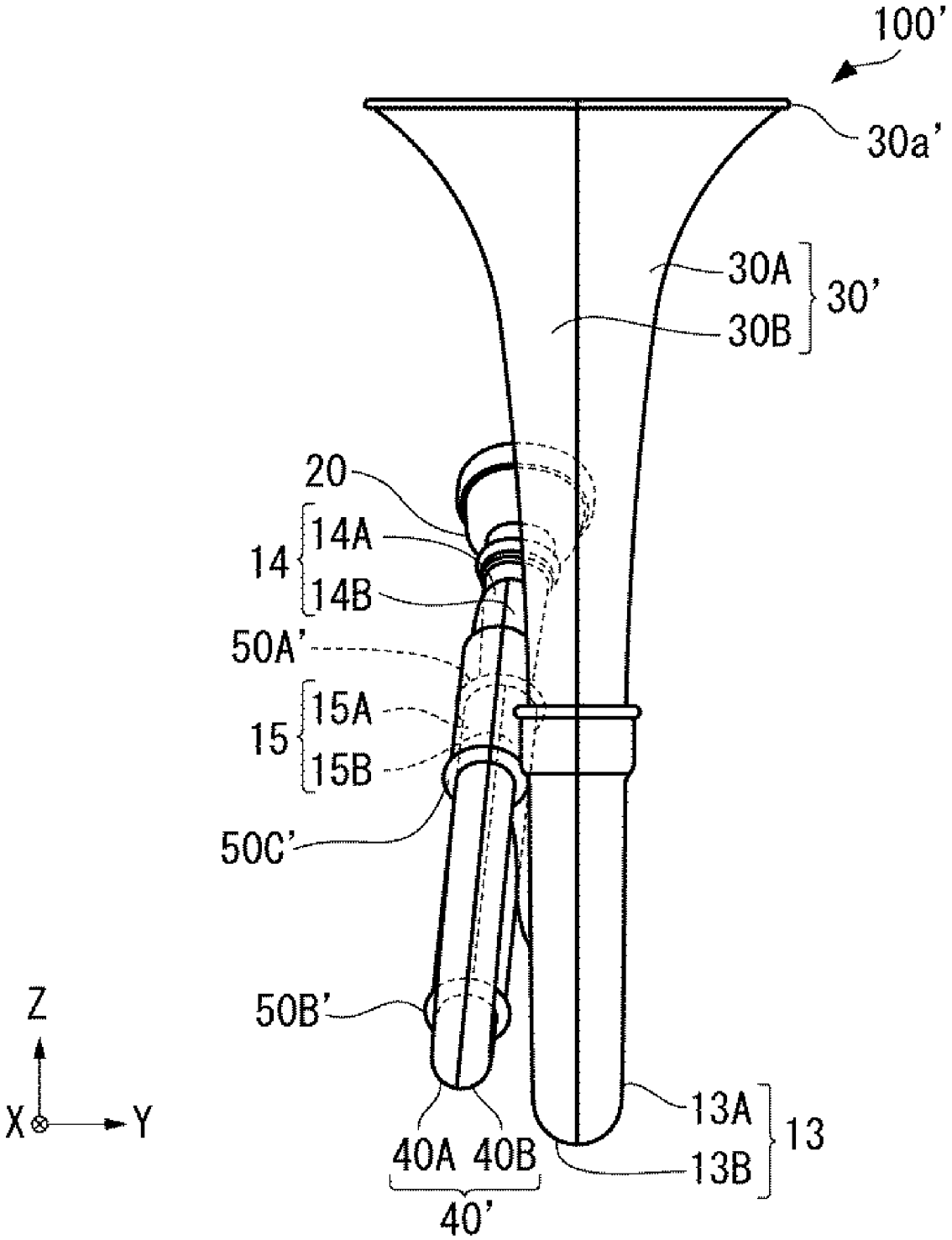

【FIG.9】
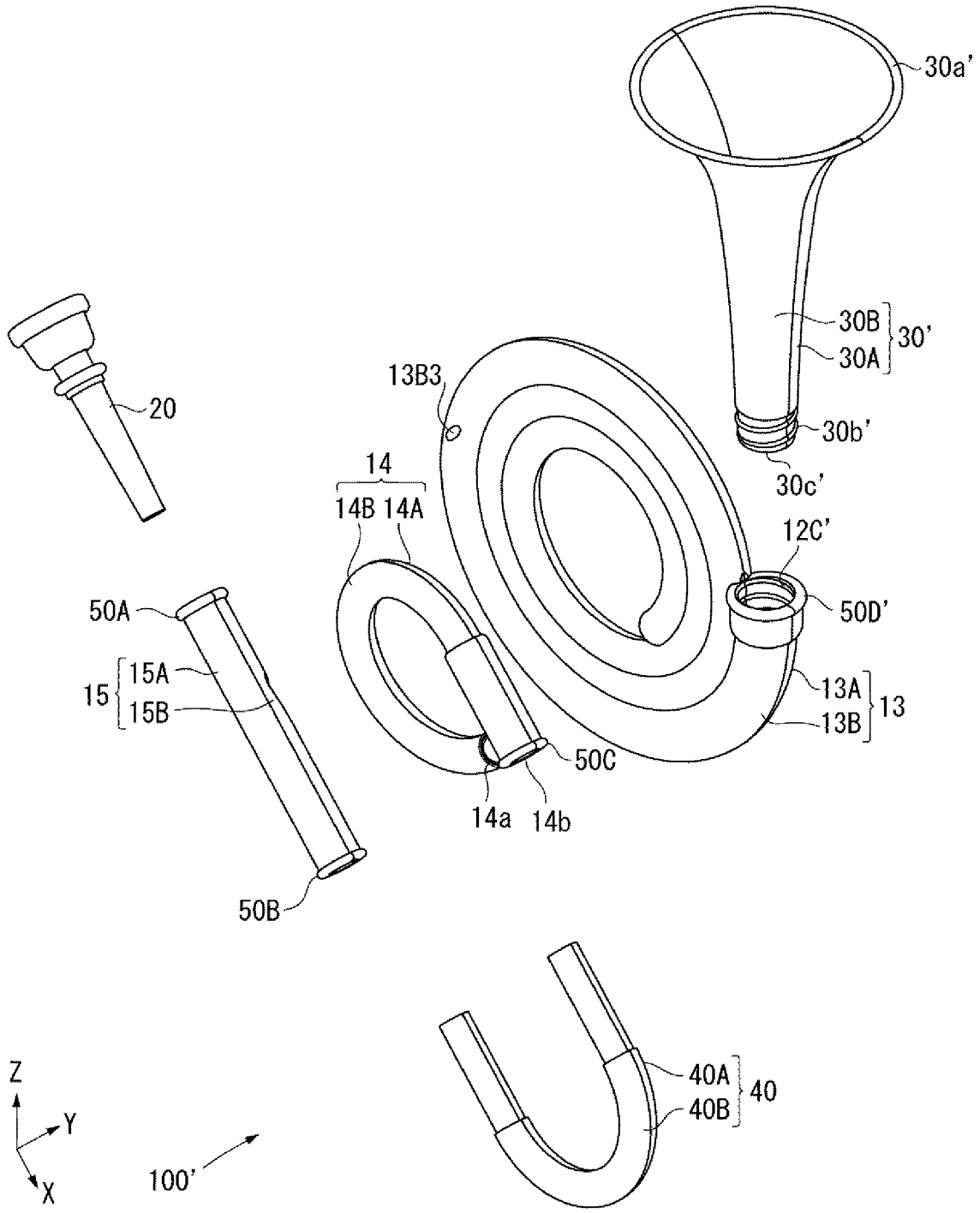

【FIG.10】
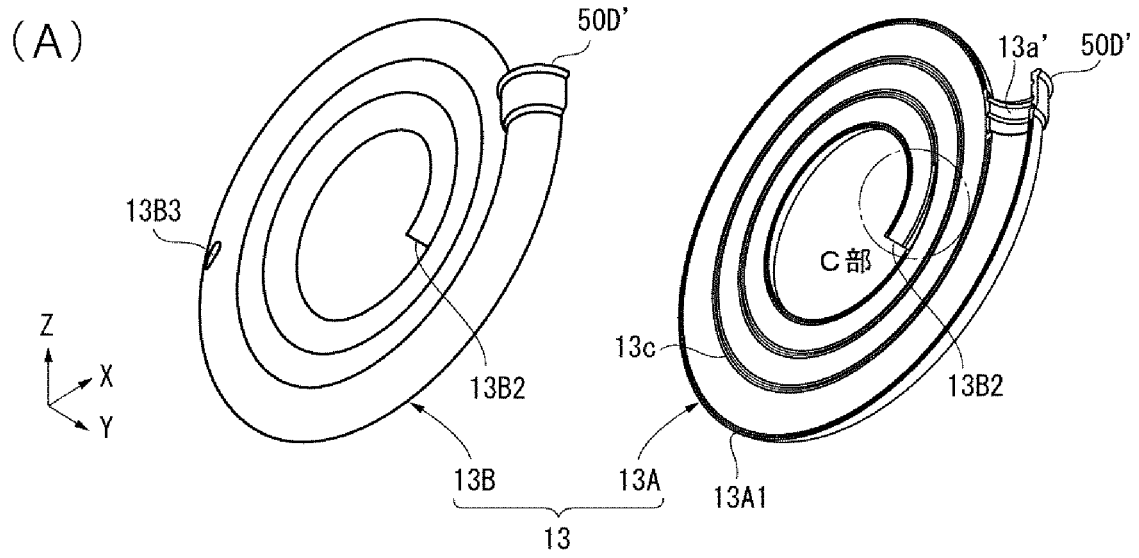
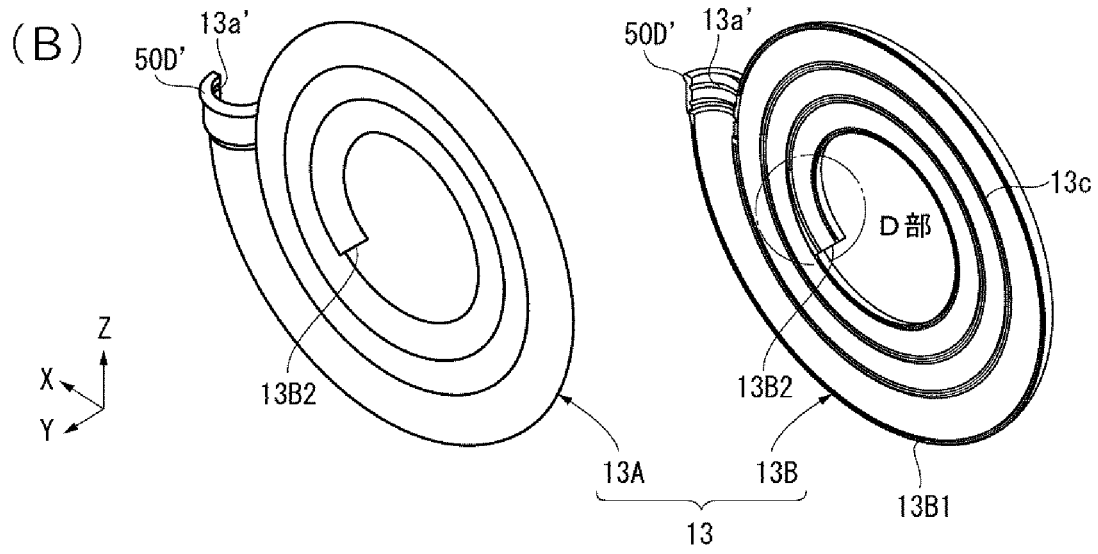

【FIG.11】
(A)
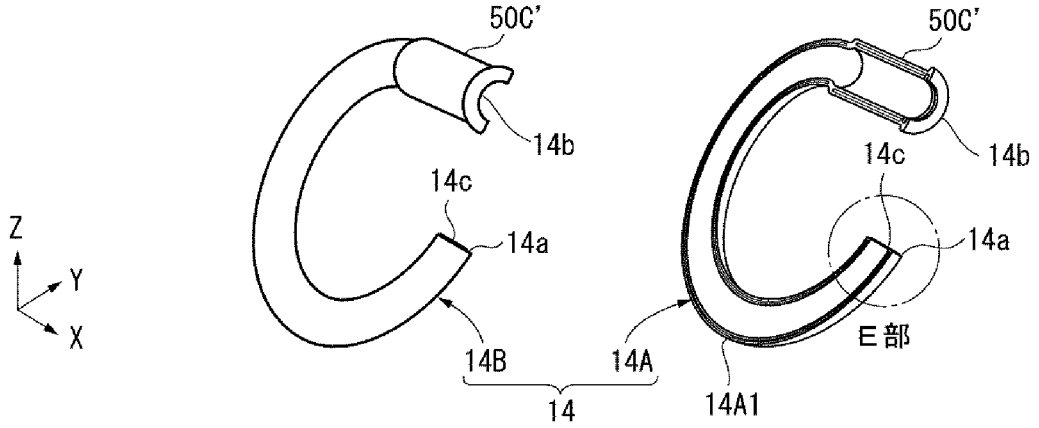
(B)
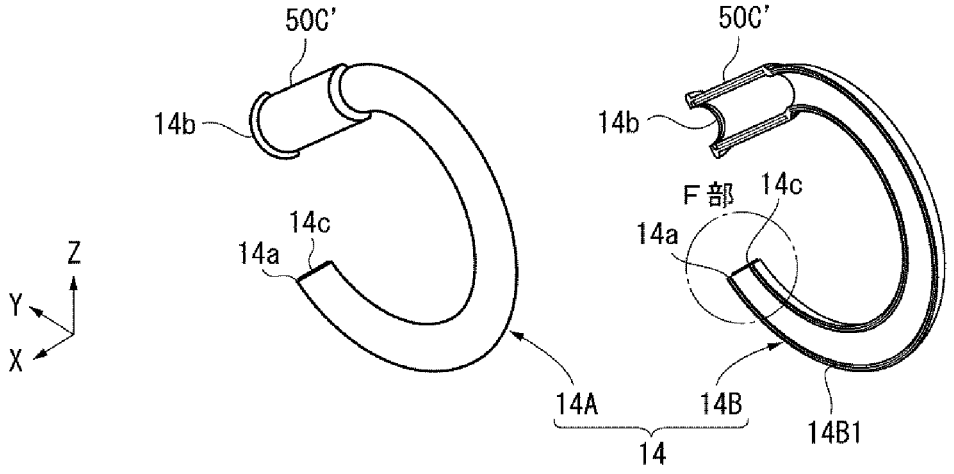

【FIG.12】
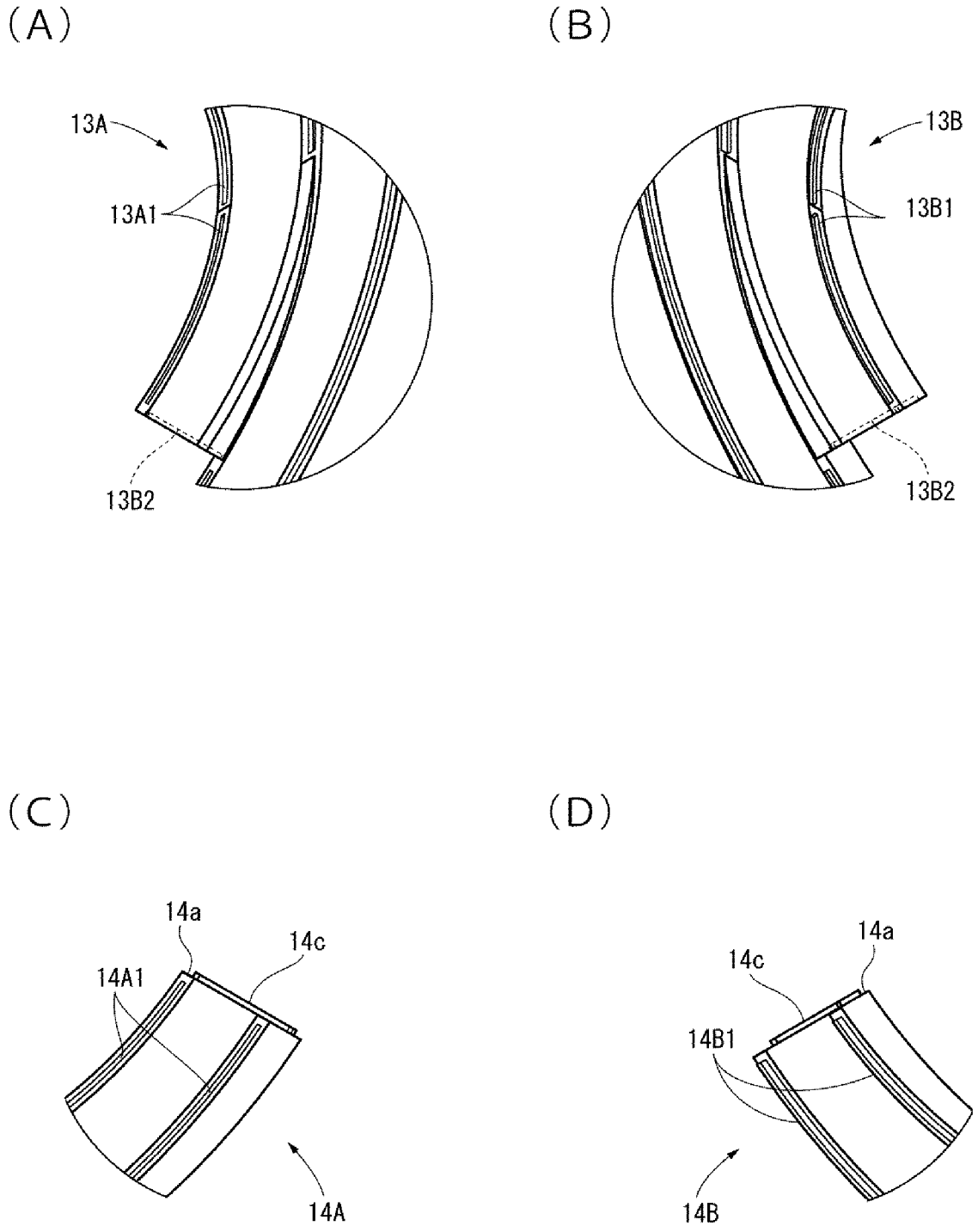

【FIG.13】
(A)
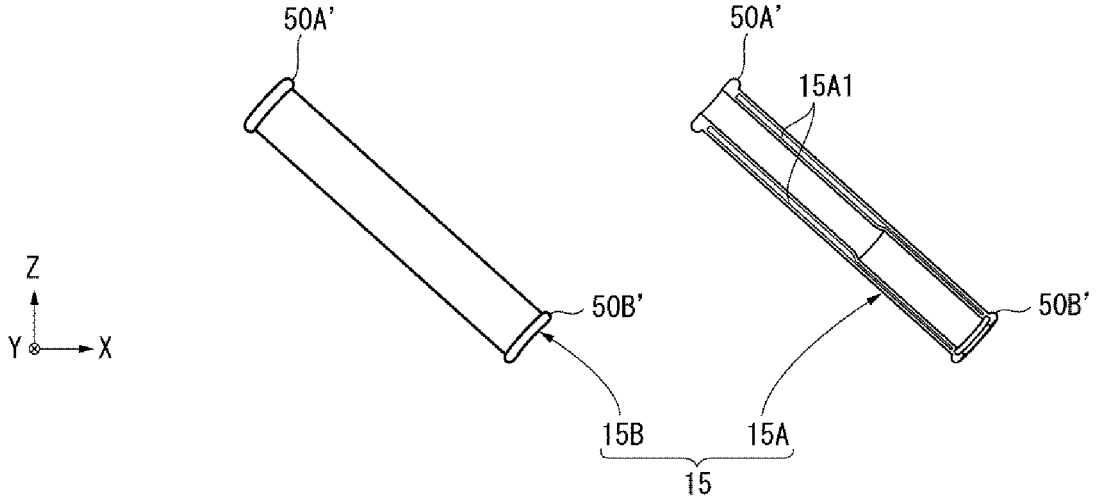
(B)
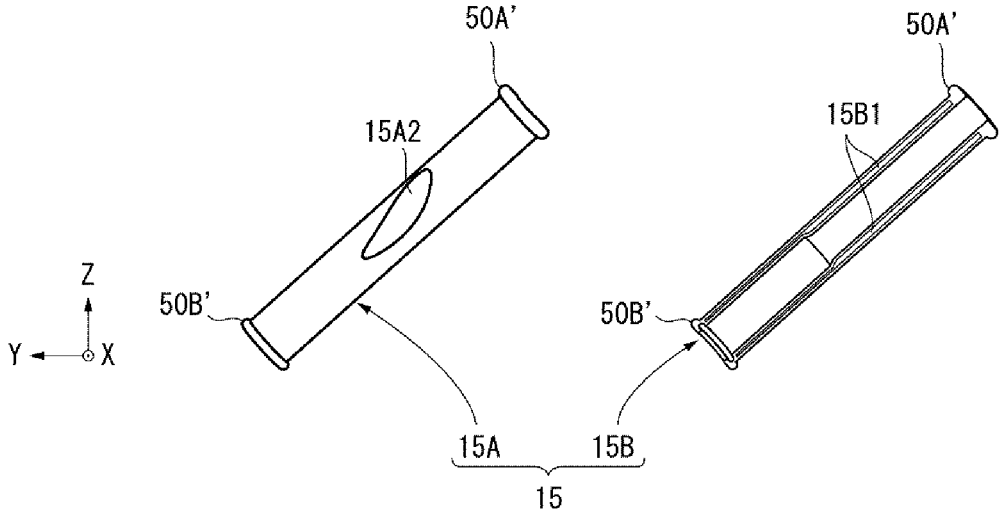

【FIG.14】
(A)
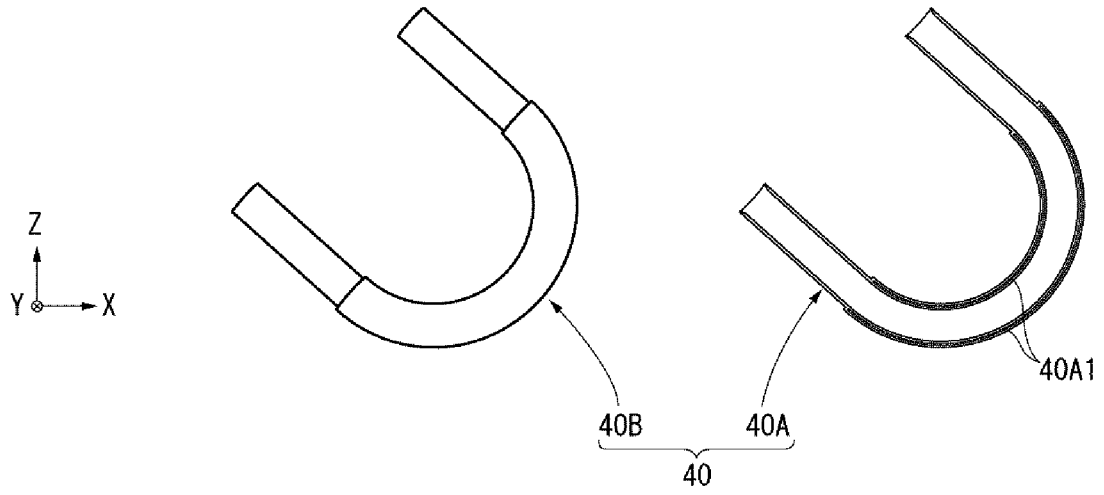
(B)
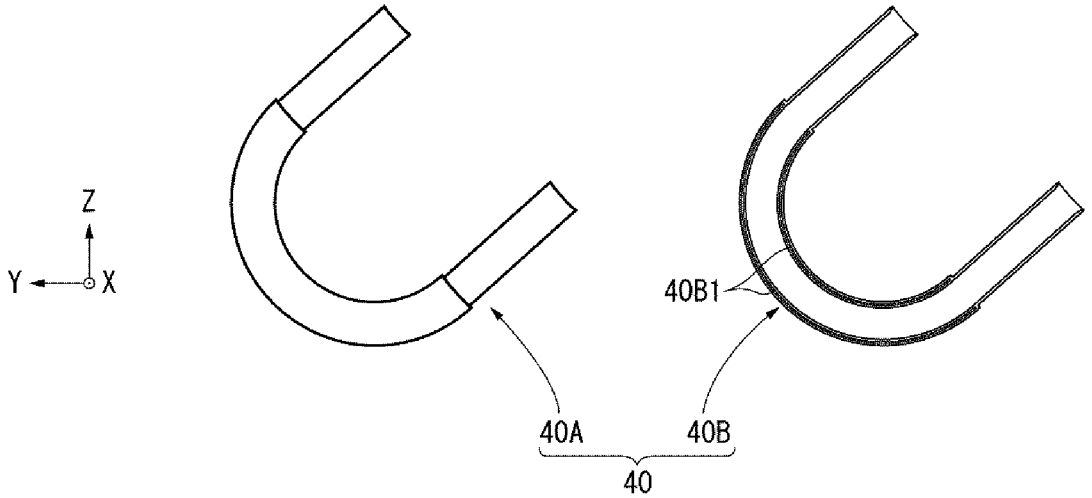

【FIG.15】
(A)
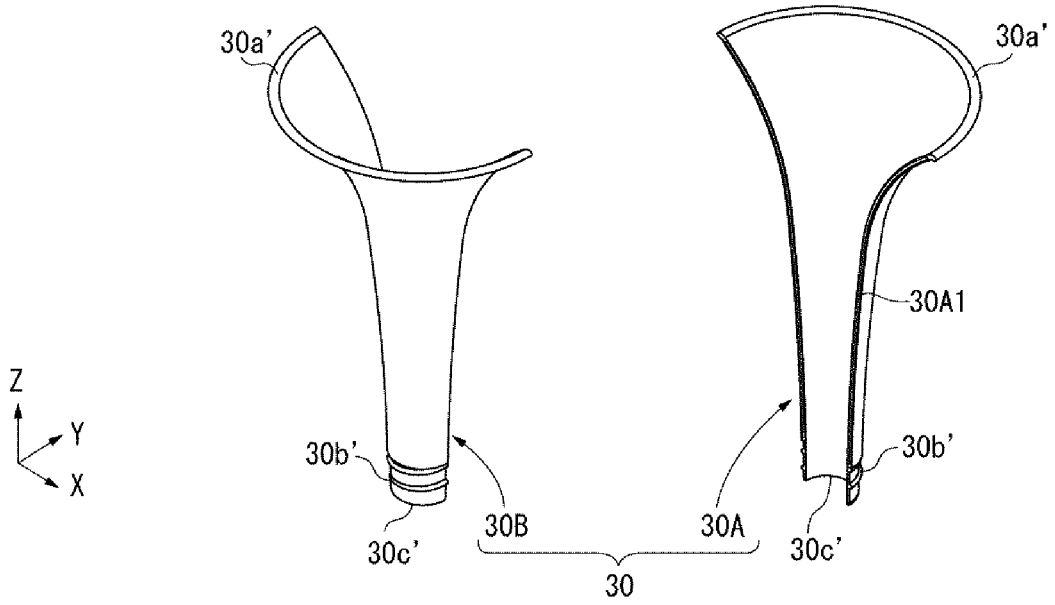
(B)
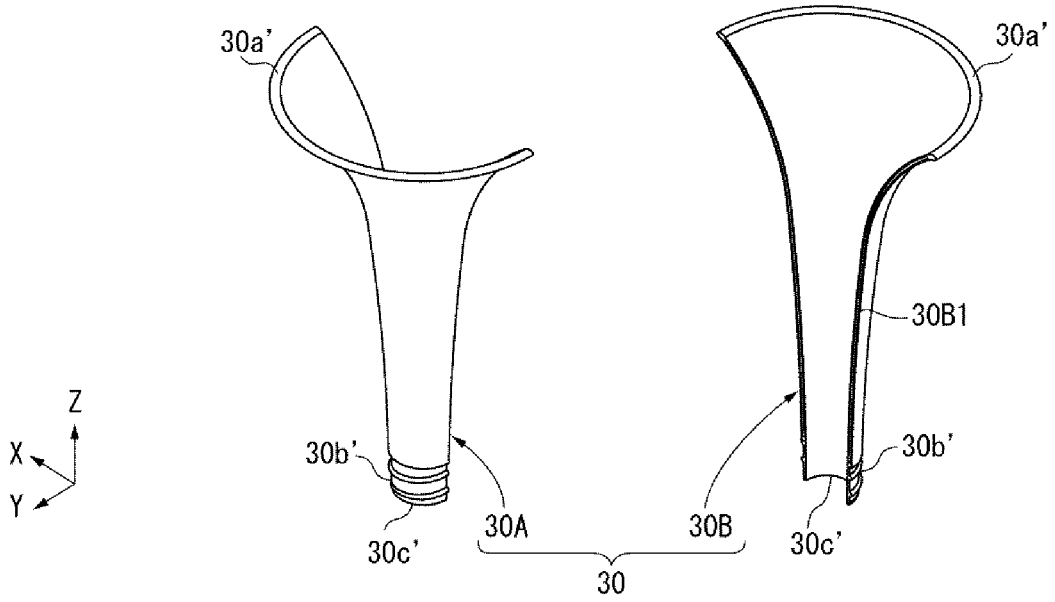

【FIG.16】
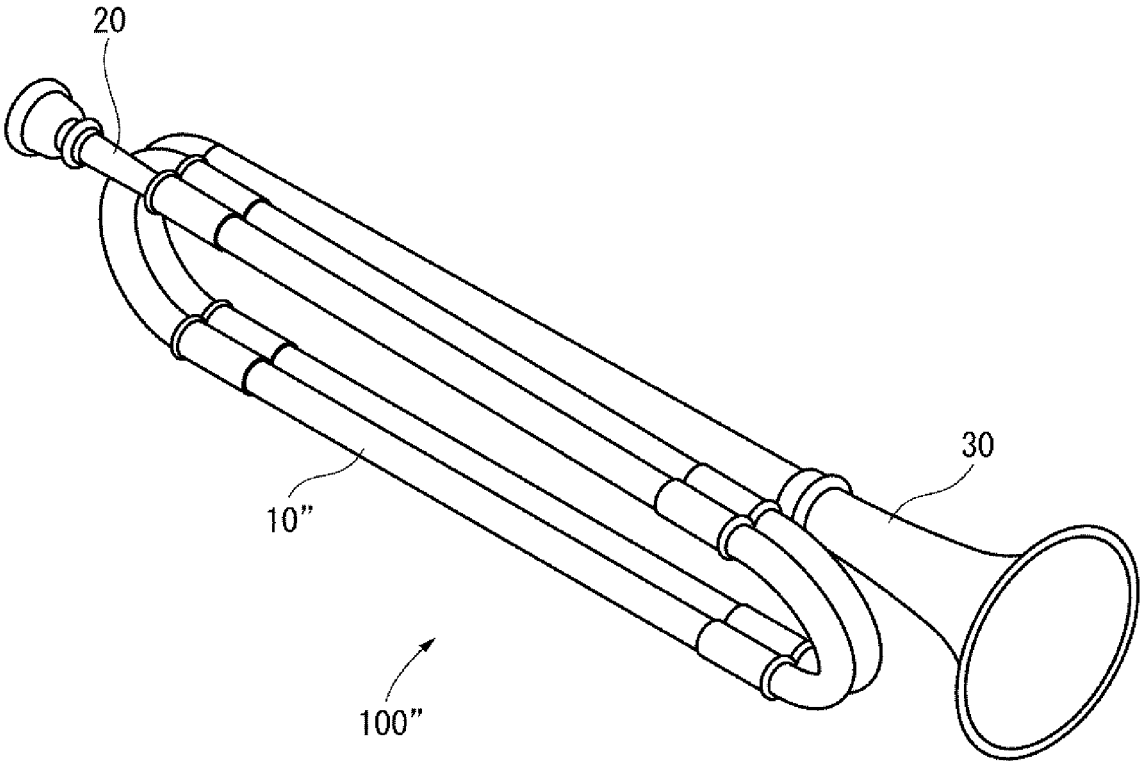
【FIG.17】
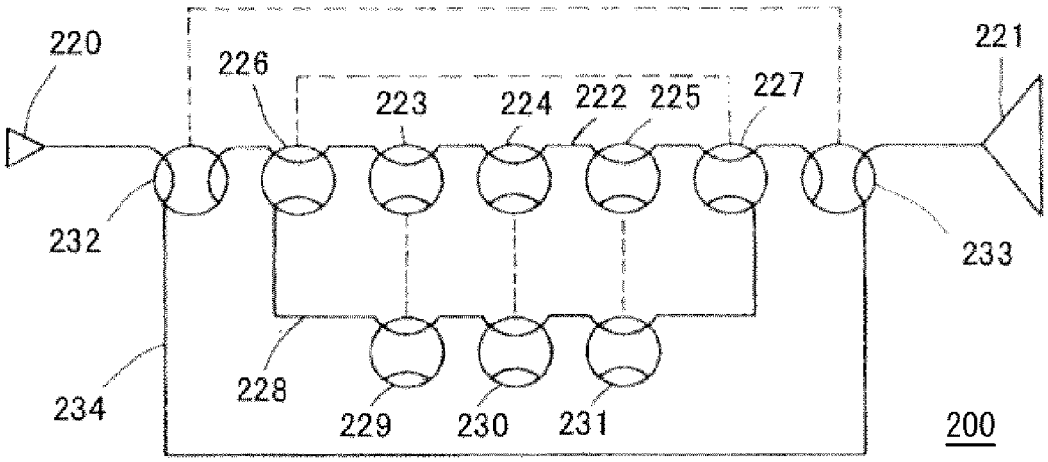

BRASS INSTRUMENT

TECHNICAL FIELD

The present invention relates to a reduction in size and weight of a brass instrument.

BACKGROUND ART

A trumpet is one of the brass instruments including a mouthpiece that converts vibrations generated by the player's lips into sound, a bell that amplifies and outputs the sound, and a main tube that communicates these two. A trumpet that does not have a valve system to change a pitch in the main tube and produces high-level harmonics is called a natural trumpet.

As a related art, Patent Literature 1 (conventional example) discloses a brass instrument 200 having a main tube 222 with tuning valves 223-225 for changing the pitch, plus a sub-tube 234 coupling a mouthpiece 220 to a bell 221, as illustrated in FIG. 17. The Patent Literature 1 also discloses the realization of a sound closer to a natural trumpet tone by switching a tube that communicates the mouthpiece 220 with the bell 221 to either the main tube 222 or the sub-tube 234, using switching valves 232 and 233.

CITATION LIST

Patent Literature

PTL 1: JP-A-55-101991

SUMMARY OF INVENTION

Technical Problem

The brass instrument 200 disclosed in the Patent Literature 1 has a problem of increasing in size and weight because of the addition of the sub-tube 234 and the switching valves 232 and 233 in addition to the basic components (the mouthpiece 220, the main tube 222 and the bell 221), as illustrated in FIG. 17.

In view of such circumstances, it is an object of the present invention to provide a brass instrument which achieves a reduction in size and weight.

Solution to Problem

An aspect of claim 1 invented to solve the above-described problem provides a brass instrument including: a mouthpiece configured to convert vibrations of player's lips into sound and take the sound inside; a bell configured to magnify a volume of the sound taken by the mouthpiece and release the sound to the outside; and a main tube interposed between the mouthpiece and the bell, wherein the main tube includes: a main tube body formed to spread out in a spiral manner on an identical plane with a side surface in a closely attached state; and a main tube connecting part having a proximal end portion attached to the main tube body and a distal end portion overlapped with the proximal end portion in a thickness direction of the main tube body, the distal end portion being positioned on the side surface of the main tube body and being connected to a part on the mouthpiece side, in which the main tube body is configured to make a part of the closely attached side surface on one side constitute a part of the closely attached side surface on the other side.

According to the aspect of the invention described in claim 1, in the main tube formed by being wound with the side surface in the closely attached state, by making the part of the closely attached side surface on the one side constitute the part of the closely attached side surface on the other side, the thickness of the closely attached side surfaces can be reduced, and an amount of material that forms the side surface can be reduced, so that the reduction in size and weight of the brass instrument is achieved. According to the aspect of the invention described in claim 1, by constituting the main tube separately with the main tube body, which spread out in a spiral manner on the identical plane and the main tube connecting part having the distal end portion being positioned on the side surface of the main tube body and connecting the main tube body with the mouthpiece side, a direction of demolding can be secured and thus resin molding of the main tube using a metal mold is enabled even when the distal end portion of the main tube connecting part overlaps with the main tube body in a spiral shape.

An aspect of the invention described in claim 2 is the brass instrument described in claim 1, in which the main tube is molded with a resin material.

According to an aspect of the invention described in claim 2, by forming the main tube spreading out in a spiral manner as it goes to an end of the bell side with a resin material, a diameter of the tube can be increased gradually toward the bell while maintaining an exact circle of the tube over an entire length and reducing the size of the main tube, so that the sound can be sent toward the bell while being gradually turned, thereby releasing a smooth sound compared with a metallic tube bent into a spiral shape.

Advantageous Effect of the Invention

The present invention provides a brass instrument in which a reduction in size and weight is achieved.

BRIEF DESCRIPTION OF DRAWINGS

FIG. 1 is a front view of a brass instrument of the first embodiment.

FIG. 2 is a side view of the brass instrument of the first embodiment.

FIG. 3 is a development view of the brass instrument illustrated in FIG. 1.

FIG. 4 is a cross-sectional view of the brass instrument illustrated in FIG. 1 taken along a line A-A.

FIG. 5 is a cross-sectional view of the brass instrument illustrated in FIG. 2 taken along a line B-B.

FIG. 6 is a front view of the brass instrument illustrated in FIG. 1 when an insertable tube of the brass instrument is replaced with a longer one.

FIG. 7 is a front view of a brass instrument of a second embodiment.

FIG. 8 is a side view of the brass instrument of the second embodiment.

FIG. 9 is a development view of the brass instrument illustrated in FIG. 7.

FIG. 10 (A) is a development view of a spiral main tube body in FIG. 9, and (B) is a development view of the spiral main tube body illustrated in (A) viewed from behind.

FIG. 11 (A) is a development view of a main tube connecting part in FIG. 9, and (B) is a development view of the main tube connecting part illustrated in (A) viewed from behind.

FIG. 12 (A) is an enlarged view of part C of a spiral tube half in FIG. 10(A), (B) is an enlarged view of part D of the spiral tube half of FIG. 10(B), (C) is an enlarged view of a part E of a connecting tube half of FIG. 11(A), and (D) is an enlarged view of part F of the connecting tube half of FIG. 11(B).

FIG. 13 (A) is a development view of a mouth pipe in FIG. 9, and (B) is a development view of the mouth pipe illustrated in (A) viewed from behind.

FIG. 14 (A) is a development view of an insertable tube in FIG. 9, and (B) is a development view of the insertable tube illustrated in (A) viewed from behind.

FIG. 15 (A) is a development view of a bell in FIG. 9, and (B) is a development view of the bell illustrated in (A) viewed from behind.

FIG. 16 FIG. 16 is a schematic diagram of a brass instrument in another embodiment.

FIG. 17 FIG. 17 is a schematic diagram illustrating a structure of a brass instrument of the related art.

DESCRIPTION OF EMBODIMENTS

First Embodiment

A brass instrument 100 of a first embodiment will be described. In the embodiments described below, dimensions, materials, shapes, and relative arrangements of the respective components are illustrative only. Directions of an X-axis, a Y-axis, and a Z-axis illustrated in each figure are common throughout.

FIG. 1 is a front view of the brass instrument 100 in the first embodiment, and FIG. 2 is a side view of the brass instrument 100 in the first embodiment when viewed from a bell 30 side.

The brass instrument 100 illustrated in FIG. 1 and FIG. 2 is a natural trumpet, which is a trumpet type. In a trumpet of the related art, a main tube for communicating a mouthpiece 20 with the bell 30 generally has an oval shape that is longer in one direction. In contrast, a spiral main tube 10 of the brass instrument 100 in the present embodiment is a spiral shape in which a single tube is wound around a plurality of times in a convolutional manner (in a gyratory manner) as illustrated in FIG. 1.

The brass instrument 100 has the spiral main tube 10, a mouth pipe 10A, the mouthpiece 20, the bell 30, and an insertable tube 40. The brass instrument 100 is also provided with coupling portions 50A, 50B, 50C, and 50D, which are the portions for coupling these various members.

The mouthpiece 20 is a member configured to convert vibrations of the player's lips into sound and take the sound inside. The mouth pipe 10A and the insertable tube 40 are members for communicating the mouthpiece 20 with the spiral main tube 10. The mouth pipe 10A has a long cylindrical shape in appearance, and the insertable tube 40 has a U-shape in appearance.

The spiral main tube 10 is the main tube located (interposed) between the mouthpiece 20 and the bell 30. The spiral main tube 10 is formed to be wound a plurality of times with a side surface of the tube in a closely attached state in appearance. The spiral main tube 10 is also formed to spread out in a spiral manner from the end of the mouthpiece 20 side as it goes toward the end of the bell 30 side.

In the present embodiment, the spiral main tube 10 and the mouth pipe 10A are formed of a resin material, such as, for example, ABS resin or cellulose nanofiber (hereinafter referred to as "resinous member"). Since the brass instrument 100 is a natural trumpet, the spiral main tube 10 of the present embodiment is not provided with tuning valves configured to vary the pitch as in the example of the related art.

The bell 30 magnifies the volume of the sound taken by the mouthpiece 20 and releases the sound to the outside. The bell 30 has a trumpet shape, for example, as illustrated in FIG. 1 and FIG. 2, with a terminal spread toward an opening end 30*a*.

Vibrations generated by the player's lips are converted into sound by the mouthpiece 20, and the sound passes through the mouth pipe 10A, the insertable tube 40, and the spiral main tube 10, is amplified by the bell 30 and is released to the outside.

FIG. 3 is a development view illustrating a state in which various portions of the brass instrument 100 are developed.

As illustrated in FIG. 3, the spiral main tube 10 may be separated from the mouthpiece 20, the bell 30, and the insertable tube 40. With the separable configuration, the mouthpiece 20, the insertable tube 40, and the bell 30 can be replaced with other ready-made parts. In contrast, the spiral main tube 10 and the mouth pipe 10A are partly joined to each other and are a single member whose surfaces are united so that they have continuity.

The mouthpiece 20 is coupled to the mouth pipe 10A by being inserted into the coupling portion 50A. The insertable tube 40 is also coupled to the mouth pipe 10A by being inserted into the coupling portion 50B and coupled to the spiral main tube 10 by being inserted into the coupling portion 50C. The bell 30 is then coupled to the spiral main tube 10 by screwing a screw 30*b* on an outer circumference of a proximal end portion 30*c* into a threaded groove 12C inside the coupling portion 50D.

When a player plays with the brass instrument 100, each portion is connected via the coupling portions 50A, 50B, 50C, and 50D, and is communicated in unison so that the brass instrument 100 is in an assembled state illustrated in FIG. 1 and FIG. 2.

FIG. 4 is a cross-sectional view of the brass instrument 100 illustrated in FIG. 1 taken along a line A-A, and FIG. 5 is a cross-sectional view of the brass instrument 100 illustrated in FIG. 2 taken along a line B-B. FIG. 4 also illustrates tube diameter dimensions for respective key points of the spiral main tube 10 (unit is in millimeters).

The spiral main tube 10 has a spiral shape in which the tube is wound in a convolutional manner, but some adjacent parts of the tube are configured to share one inner wall (side surface) 11. Specifically, a tube 12A, which is any part, and an adjacent tube 12B, which is adjacent to the tube 12A, of the spiral main tube 10 are originally configured to include—an inner space of the tube 12A—a sidewall of the tube 12A—a sidewall of the adjacent tube 12B—and an inner space of the adjacent tube 12B lined up in this order. However, the brass instrument 100 of the present embodiment includes—the inner space of the tube 12A—an inner wall 11—the inner space of the adjacent tube 12B. In other words, the brass instrument 100 of the present embodiment has a configuration at a location where the tubes of the spiral main tube 10 are closely attached with each other, in which part of the side surface (inner wall 11) of one of the tubes (the tube 12A) constitutes part of the side surface of the other tube (adjacent tube 12B).

As in the present embodiment, the configuration in which a part of the side surface 11 of one of the tubes constitutes part of the side surface 11 of the other tube allows the brass instrument 100 to reduce in weight and size. Regarding the reduction in size, the brass instrument 100 with the mouthpiece 20 removed can be made as small as being accommodated in A4 size (210 mm×297 mm), which is a standard of paper sizes illustrated in FIG. 5. In this manner, according to the present embodiment, at least the size in front view of the brass instrument 100 can be accommodated in A4 size.

In the present embodiment, as illustrated in FIG. 4, by molding and forming the spiral main tube 10 with a resin material to spread out in a spiral manner as it goes from the end of the mouthpiece 20 side to the end of the bell 30 side, the sound taken into the mouthpiece 20 can be sent to the bell 30 while being tuned in the spiral main tube 10.

Also, in the present embodiment, by forming the spiral main tube 10 into the spiral shape with the resin material, the spiral main tube 10 can be maintained in an exact circular shape over the entire part as illustrated in FIG. 4 without being subject to collapse or the like that may occur when a metal tube is bent by using an injection molding machine or the like. In other words, in the present embodiment, by molding the spiral main tube 10 with a resin material, the exact circle shape can be maintained over the entire part of the tube having the spiral shape so that the sound released from the bell 30 can be made smooth compared with the brass instrument formed by bending a metal.

FIG. 6 is a drawing illustrating a configuration in which an insertable tube 60, which is different in length (tube length) from the insertable tube 40, is coupled. The brass instrument 100 can be switched to an F tube, an E flat tube, a D tube, and a C tube by replacing the insertable tubes 40. In the present embodiment, switching among the F tube, E flat tube, the D tube, and the C tube is achieved by using the insertable tubes 60, which makes the entire length of the brass instrument 100 have lengths of 1890 mm, 2135 mm, 2276 mm, and 2582 mm.

As illustrated in FIG. 6, even when the insertable tubes 60 is an elongated tube, the reduction in size to an extent as illustrated in FIG. 5, that is, to an extent as small as being accommodated in A4 size is achieved by a configuration in which the tube is folded in the Y-axis direction (a direction perpendicular to an X-Z plane).

As in the present embodiment, the spiral main tube 10 can be made into a spiral shape and share adjacent parts of the side surface 11 of the tube to reduce in weight and size. Concerning weight reduction, the reduction in weight more than the metallic tube is achieved by making at least a part of the brass instrument 100 (the spiral main tube 10 and the mouth pipe 10A in the present embodiment) of resin material as in the present embodiment. By achieving the reduction in size and weight as in the present embodiment, the player can easily carry and support the brass instrument 100 during a performance.

Furthermore, the strength of the brass instrument 100 can be increased by making the spiral main tube 10 and the mouth pipe 10A a single, integrated member with continuity. Assuming that the spiral main tube 10 and the mouth pipe 10A are separate, when assembled, it will have a separate configuration in which only the portion including the insertable tube 40, the mouth pipe 10A, the mouthpiece 20 is coupled to the spiral main tube 10 by the coupling portion 50C. In this case, the portion including the insertable tube 40, the mouth pipe 10A, and the mouthpiece 20 is relatively long and structurally unstable since the end of the mouthpiece 20 (the end on the side where the player blows) is a free end. For example, when the player's lips touch the mouthpiece 20, even if the spiral main tube 10 is supported, the portion including the insertable tube 40, the mouth pipe 10A, and the mouthpiece 20 may sway. Also, if an impact is applied to the brass instrument 100, an excessive load may be applied to an area around the coupling portion 50C, which may not withstand the impact and may break. Such risks are even more pronounced when replaced with the insertable tube 60 longer than the insertable tube 40.

As in the present embodiment, by interposing the mouth pipe 10A integrated with the spiral main tube 10 between the insertable tube 40 and the mouthpiece 20, elongation of the member is suppressed, and the strength of the brass instrument 100 can be increased.

The brass instrument 100 of the present embodiment, even if the tube length is about twice as long as the tube length of a trumpet of low order harmonics, such as a natural trumpet, has a spiral shape with the tubes wound in a convolutional manner and the spiral main tube 10 with a part of the adjacent innerwalls 11 shared so that the reduction in size of the spiral main tube 10 in front view to a size that can be accommodated into A4 size is achieved.

Second Embodiment

A brass instrument 100' of a second embodiment will be described. Since each of the roles of a mouthpiece 20, a mouth pipe 15, a spiral main tube 10', an insertable tube 40' and a bell 30' of the present embodiment is identical to those of the first embodiment, and the configuration of the mouthpiece 20 is the same as that of the first embodiment, the same reference signs are appended, and the explanation is omitted here.

FIG. 7 is a front view of the brass instrument 100' of the second embodiment, FIG. 8 is a side view of the brass instrument 100' of the second embodiment, and FIG. 9 is a development view illustrating various portions of the brass instrument 100' illustrated in FIG. 7 in a developed manner.

The brass instrument 100, 100' includes a spiral main tube (main tube) 10', the mouth pipe 15, the mouthpiece 20, the insertable tube 40' and the bell 30', as illustrated in FIG. 7 to FIG. 9. The brass instrument 100' is also provided with coupling portions 50A', 50B', 50C', and 50D', which are the portions for coupling these various members.

As illustrated in FIG. 7 and FIG. 9, the spiral main tube 10' includes a spiral main tube body (main tube body) 13 formed to spread out in a spiral manner with a side surface 13*c* closely attached to each other on an identical plane, and a main tube connecting part 14 having a proximal end portion 14*a* attached to the spiral main tube body 13 and a distal end portion 14*b* overlapped with the proximal end portion 14*a* in a thickness direction of the spiral main tube body 13, the distal end portion 14*b* being positioned on the side surface 13*c* of the spiral main tube body 13.

The spiral main tube body 13 has a spiral shape in which the tube has been wound a plurality of times in a convolutional manner (in a gyratory manner), similar to the spiral main tube 10' of the first embodiment, and is configured to share a part of the inner wall (side surface) 13*c* of the adjacent tubes.

The spiral main tube body 13 includes, at one end portion thereof, the coupling portion 50D' formed at an inner side thereof with a threaded groove 12C' to be engaged with a thread 30*b*' on an outer periphery of a proximal end portion 30*c*' of the bell 30' and, at the other end surface thereof, a recessed portion 13B2.

The main tube coupling part 14 has a ring shape substantially, as illustrated in FIG. 7 to FIG. 9 and includes the coupling portion 50C' at the distal end portion 14*b* thereof for inserting an end portion of the insertable tube 40'. A protruding portion 14*c*, which fits into the recessed portion 13B2, is formed at the proximal end portion 14*a* of the main tube connecting part 14.

The mouth pipe 15 has a long cylindrical shape, as illustrated in FIG. 7 to FIG. 9, and includes, at one end side, the insertable tube 40' and, at the other end side, the mouth piece 20 configured to allow insertion.

In the brass instrument 100' of the present embodiment, the spiral main tube body 13, the main tube connecting part 14, the mouth pipe 15, and the mouthpiece 20 can be assembled integrally by screwing the bell 30' to the coupling portion 50D' of the spiral main tube body 13, fitting the recessed portion 13B2 on the protruding portion 14*c*, inserting the insertable tube 40' to the coupling portion 50C' of the main tube connecting part 14 and the one end side of the mouth pipe 15, and inserting the mouthpiece 20 on the other end side of the mouth pipe 15.

The brass instrument 100' of the present embodiment separately includes the spiral main tube 10' including the spiral main tube body 13 formed to spread out in a spiral manner with the side surface 13*c* closely attached to each other on an identical plane, and the main tube connecting part 14 including the distal end portion 14*b* overlapped with the proximal end portion 14*a* in the thickness direction of the spiral main tube body 13 so that a direction of demolding can be secured and thus the spiral main tube 10' can be molded with a metal mold.

Furthermore, the spiral main tube body 13, the main tube connecting part 14, the mouth pipe 15, the bell 30', and the insertable tube 40', which constitute the brass instrument 100' of the present embodiment, may be formed by resin molding using a metal mold by being formed of a pair of divided tube halves, etc., as described below. A specific configuration will be explained below.

FIG. 10(A) is a development view of the spiral main tube body 13 in FIG. 9, and (B) is a development view of the spiral main tube body 13 illustrated in (A) viewed from behind. FIG. 11(A) is a development view of the main connecting part 14 in FIG. 9, and (B) is a development view of the main tube coupling part 14 illustrated in (A) viewed from behind. FIG. 12 (A) is an enlarged view of a part C of a spiral tube half 13B in FIG. 10(A), (B) is an enlarged view of a part D of a spiral tube half 13A of FIG. 10(B), (C) is an enlarged view of a part E of a connecting tube half 14B of FIG. 11(A), and (D) is an enlarged view of a part F of a connecting tube half 14A of FIG. 11(B). FIG. 13(A) is a development view of the mouth pipe 15 in FIG. 9, and (B) is a development view of the mouth pipe 15 illustrated in (A) viewed from behind. FIG. 14(A) is a development view of the insertable tube 40' in FIG. 9, and (B) is a development view of the insertable tube 40' illustrated in (A) viewed from behind. FIG. 15(A) is a development view of the bell 30' in FIG. 9, and (B) is a development view of the bell 30' illustrated in (A) viewed from behind.

The spiral main tube body 13, the main tube connecting part 14, the mouth pipe 15, and the insertable tube 40' are formed of the pairs of the spiral tube halves 13A and 13B, the connecting tube halves 14A and 14B, mouth pipe halves 15A and 15B, and insertable tube halves 40A and 40B as illustrated in FIG. 10 to FIG. 14. The spiral tube halves 13A and 13B, the connecting tube halves 14A and 14B, the mouth pipe halves 15A and 15B and the insertable tube halves 40A and 40B are made of a resin material and have, on each of mating surfaces, protruding portions 13B1, 14B1, 15A1, 40A1, and 30A1 and recessed portions 13B2, 14A1, 15B1, 40B1, and 30B1.

A recessed portion 13B3 for fitting the coupling portion 50A' of the mouth pipe half 15A is formed on an outer peripheral surface of the spiral tube half 13B, as illustrated in FIG. 10(A). Also, a groove portion 15A2 in which an outer surface of the spiral tube half 13B fits is formed on an outer surface of the mouth pipe half 15A as illustrated in FIG. 13(B).

The bell 30' is divided longitudinally, as illustrated in FIG. 13, and includes a pair of bell halves 30A and 30B made of the resin material. The mating surfaces of the bell halves 30A and 30B are formed with the recessed portion 30B1 and the protruding portion 30A1.

The brass instrument 100' of the present embodiment can eliminate the portion which may be caught in the demolding direction and can be formed easily by resin molding using the metal mold by constituting the spiral main tube body 13, the main tube connecting part 14, the mouth pipe 15, the insertable tube 40' and the bell 30' with the pairs of the spiral tube halves 13A and 13B, the connecting tube halves 14A and 14B, the mouth pipe halves 15A and 15B, the insertable tube halves 40A and 40B, and the bell halves 30A and 30B.

In the brass instrument 100' of the present embodiment, as shown in FIG. 10 to FIG. 15, the spiral main tube body 13, the main tube connecting part 14, the mouth pipe 15, the insertable tube 40 and the bell 30' can be assembled integrally by fitting the protruding portions 13B1, 14B1, 15A1, 40A1, and 30A1 to the recessed portions 13B2, 14A1, 15B1, 40B1, 30B1 formed on the respective mating surfaces of the pairs of the spiral tube halves 13A and 13B, the connecting tube halves 14A and 14B, the mouth pipe halves 15A and 15B, the insertable tube halves 40A and 40B, and the bell halves 30A and 30B.

Similarly, in the brass instrument 100' of the present embodiment, the spiral main tube 10' can be formed by integrally assembling the spiral main tube body 13 and the main tube connecting part 14 easily by fitting the recessed portion 13*b* of the spiral main tube body 13 and the protruding portion 14*c* of the main tube connecting part 14.

The brass instrument 100' of the present embodiment, as illustrated in FIG. 10 to FIG. 15, can easily secure the demolding direction of the metal mold when molding the respective components by resin molding using the metal mold by forming the pairs of the spiral tube halves 13A and 13B, the connecting tube halves 14A and 14B, the mouth pipe halves 15A and 15B, the insertable tube halves 40A and 40B, and the bell halves 30A and 30B in combination.

Also, in the brass instrument 100' of the present embodiment, swinging of the mouth pipe 15 and the insertable tube 40' can be reduced when the player plays the brass instrument 100' by fixing the position of the mouth pipe 15 with respect to the spiral main tube body 13 and fitting the coupling portion 50A' of the mouth pipe half 15A to the recessed portion 13B3 of the spiral tube half 13B and the spiral tube half 13B to the groove portion 15A2 of the mouth pipe half 15A.

Furthermore, in the brass instrument 100' of the present embodiment, similar to the brass instrument 100 of the first embodiment, the reduction in weight and size of the brass instrument 100' is achieved by configuring part of the side surface 13C of the closely attached tube on one side to form part of the side surface 13C of the closely attached the other tube on the other side.

Furthermore, in the brass instrument 100' of the present embodiment, similar to the brass instrument 100 of the first embodiment, by molding the spiral main tube 10' with the resin material and increasing the tube diameter of the spiral main tube 10' toward the bell 30' side as well as maintaining the exact circle shape over the entire length of the tube, the sound taken into the mouthpiece 20 can be sent to the bell 30' side while being turned, and the sound released from the bell 30' can be made smooth.

Other Embodiments

In the first embodiment and the second embodiment, the main tubes 10 and 10' are described as having a spiral shape, but as illustrated in FIG. 16, the main tube 10" may be configured to be formed into an oval shape and turn a plurality of times. In this case, parts of the adjacent sidewalls of the main tube 10, 10' are shared in the same manner as the spiral main tube 10" of the first embodiment and the second embodiment. In this manner, by sharing parts of the adjacent sidewalls, the reduction in size and weight of an entire brass instrument 100" is achieved.

In the brass instrument 100" of the second embodiment, the mouth pipe 15, the insertable tube 40', and the bell 30' have been described as being configured with the pairs of the mouth pipe halves 15A and 15B, the insertable tube halves 40A and 40B, and the bell halves 30A and 30B, but may be formed of a single component as in the first embodiment.

Furthermore, the brass instrument 100' of the second embodiment has been described as a configuration of forming the protruding portions 13B1, 14B1, 15A1, 40A1, and 30A1 and the recessed portions 13B2, 14A1, 15B1, 40B1, and 30B1 on the mating surfaces of the pairs of the spiral tube halves 13A and 13B, the connecting tube halves 14A and 14B, the mouth pipe halves 15A and 15B, the insertable tube halves 40A and 40B, and the bell halves 30A and 30B and integrally assembling the spiral main tube body 13, the main tube connecting part 14, the mouth pipe 15, the insertable tube 40' and the bell 30', but is not limited thereto as long as the integral assembly is possible.

In the present embodiment, the natural trumpet, which is a type of trumpet, has been described as an example, but the mode of the present embodiment can be applied to brass instruments in general.

As described thus far, the modes of the present embodiment provide a brass instrument 100, 100', 100" in which the reduction in size and weight is achieved.

The present invention may be implemented in various forms without deviating from the spirit or principal features. Therefore, the embodiments described above are, in every respect, illustrative only and should not be construed as limiting. The scope of the present invention is indicated by the claims and is not bound in any way to the text of the specification. Furthermore, all variations, various improvements, substitutions, and modifications that fall within the equal scope of the claims are within the scope of the present invention.

REFERENCE SIGNS LIST

10, 10', 10": spiral main tube (main tube)
10A: mouth pipe
11: inner wall (side surface)
12A, 12B: tube
12C, 12C': threaded groove
13: spiral main tube body (main tube body)
13*a*, 13*a*': threaded groove
13*b*: recessed portion
13*c*: side surface
13A, 13B: spiral tube half
13A1: recessed portion
13B1: protruding portion
13B2: recessed portion
13B3: recessed portion
14: main tube connecting part
14*a*: proximal end portion
14*b*: distal end portion
14*c*: protruding portion
14A, 14B: connecting tube half
14A1: recessed portion
14B1: protruding portion
15: mouth pipe
15A, 15B: mouth pipe half
15A1: protruding portion
15A2: groove portion
15B1: recessed portion
20: mouthpiece
30, 30': bell
30*a*, 30*a*': opening end portion
30*b*, 30*b*': screw
30*c*, 30*c*': proximal end portion
30A, 30B: bell half
30A1: protruding portion
30B1: recessed portion
40, 40', 60: insertable tube
40A, 40B: insertable tube half
40A1: protruding portion
40B1: recessed portion
50A, 50A', 50B, 50B', 50C, 50C', 50D, 50D': coupling portion
100, 100', 100": brass instrument

The invention claimed is:

1. A brass instrument comprising:

a mouthpiece configured to convert vibrations of player's lips into sound and take the sound inside;

a bell configured to magnify a volume of the sound taken by the mouthpiece and release the sound to the outside; and, a main tube interposed between the mouthpiece and the bell, wherein the main tube includes:

a main tube body formed to be spread out in a spiral manner on an identical plane with side surface in a closely attached state; and a main tube connecting part having a proximal end portion attached to the main tube body and a distal end portion overlapped with the proximal end portion in a thickness direction of the main tube body, the distal end portion being positioned on the side surface of the main tube body and being connected to a part on the mouthpiece side, wherein the main tube body is configured to make a part of the closely attached side surface on one side of the tube constitute a part of the closely attached side surface on the other side of the tube.

2. The brass instrument according to claim 1, wherein the main tube is molded with a resin material.

* * * * *